United States Patent [19]

Adams, Jr.

[11] 4,310,207

[45] Jan. 12, 1982

[54] MULTI-PURPOSE FURNITURE

[76] Inventor: John Adams, Jr., 1027 Valley Forge Rd., Devon, Pa. 19333

[21] Appl. No.: 96,794

[22] Filed: Nov. 23, 1979

[51] Int. Cl.[3] ..... A47B 43/00; A47B 5/00

[52] U.S. Cl. ..... 312/314; 312/317 R; 312/258; 108/38; 108/48

[58] Field of Search ..... 312/314, 317 R, 317 A, 312/258; 108/38, 40, 48

[56] References Cited

U.S. PATENT DOCUMENTS

| | | | |
|---|---|---|---|
| D. 84,667 | 7/1931 | Conners | 108/38 |
| D. 157,781 | 3/1950 | Pahlmann | 312/314 |
| 817,596 | 4/1906 | Siebenthal | 108/48 |
| 1,158,212 | 10/1915 | Henderson | 312/314 |
| 1,195,964 | 8/1916 | Bradley | 312/314 |
| 1,200,071 | 10/1916 | Barler | 312/314 |
| 2,122,969 | 7/1938 | Whitcomb | 312/314 |
| 2,547,808 | 4/1951 | Burrage | 312/314 |
| 2,655,420 | 10/1953 | Hadley | 312/317 R |
| 3,602,569 | 8/1971 | Caputo | 312/314 |
| 3,606,509 | 9/1971 | Bennett | 312/317 R |

*Primary Examiner*—Victor N. Sakran

[57] ABSTRACT

A primary storage or support unit adapted to rest on a floor or be supported above the floor. The unit pivotally mounts a flat work panel which can be moved into a horizontal orientation where it serves as a desk or table or moved into a vertical orientation where it serves as part of a display and/or a cover for the storage unit. The work panel pivotally carries a utility member which supports the panel when it is horizontal and which frames intelligence on the work panel when it is vertical and serves as a display.

6 Claims, 10 Drawing Figures

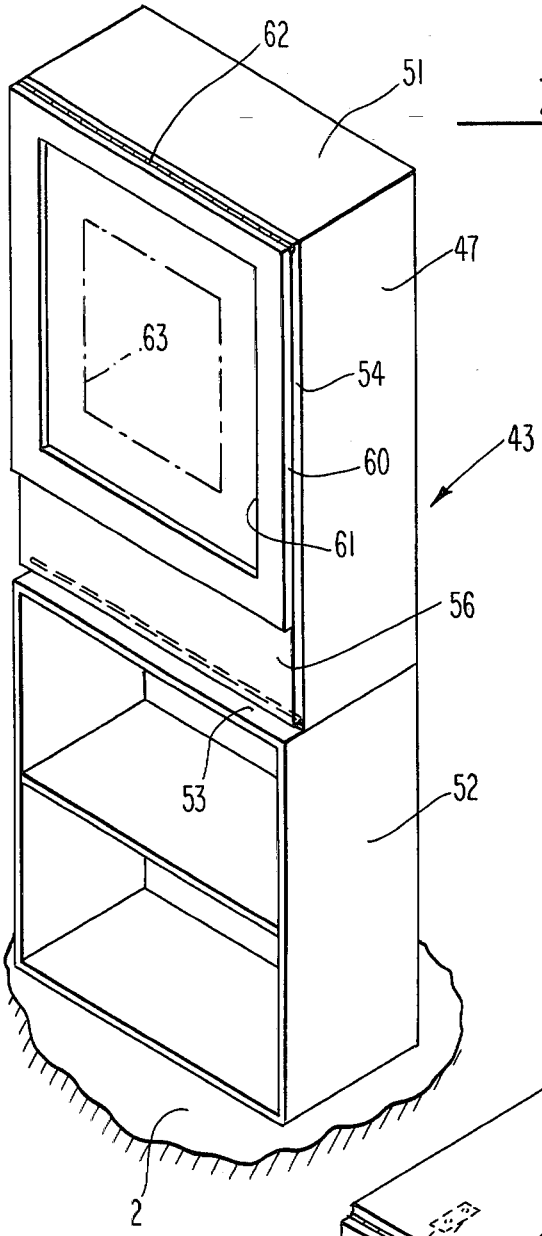
Fig. 5
Fig. 6
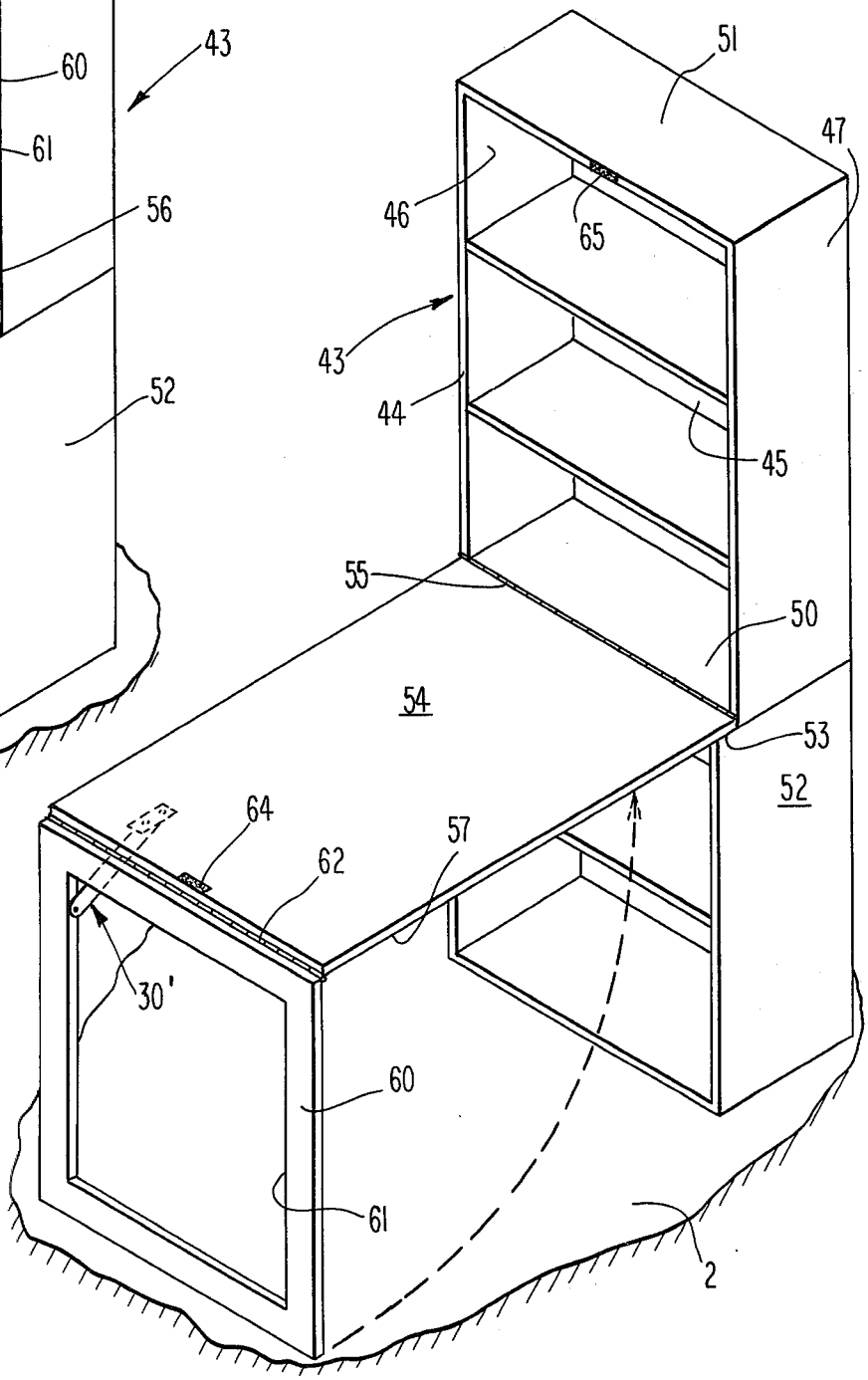

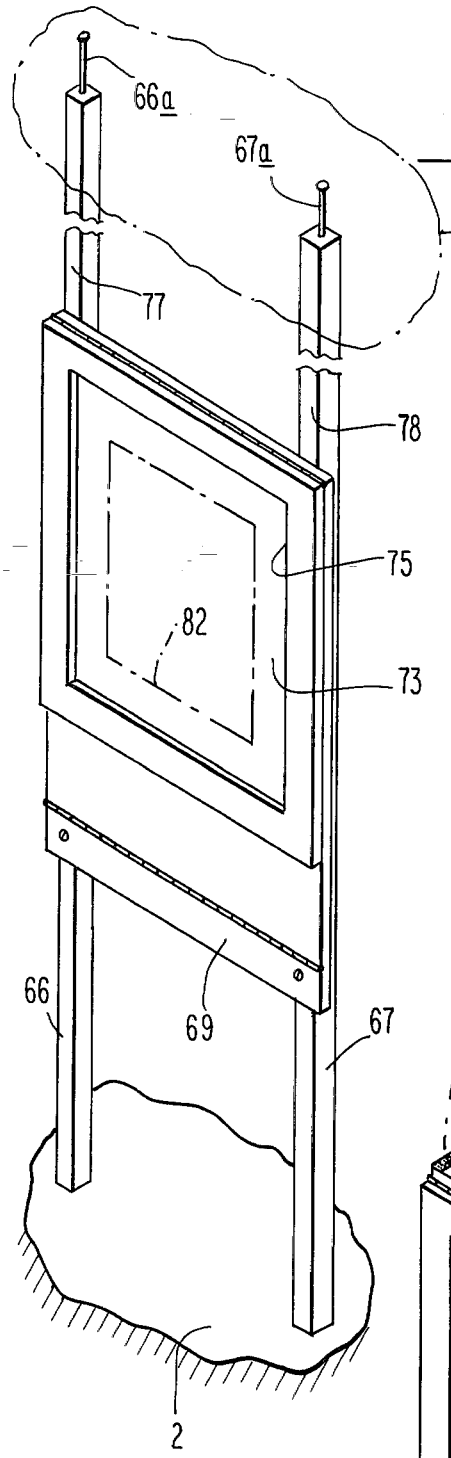
Fig. 7
Fig. 8
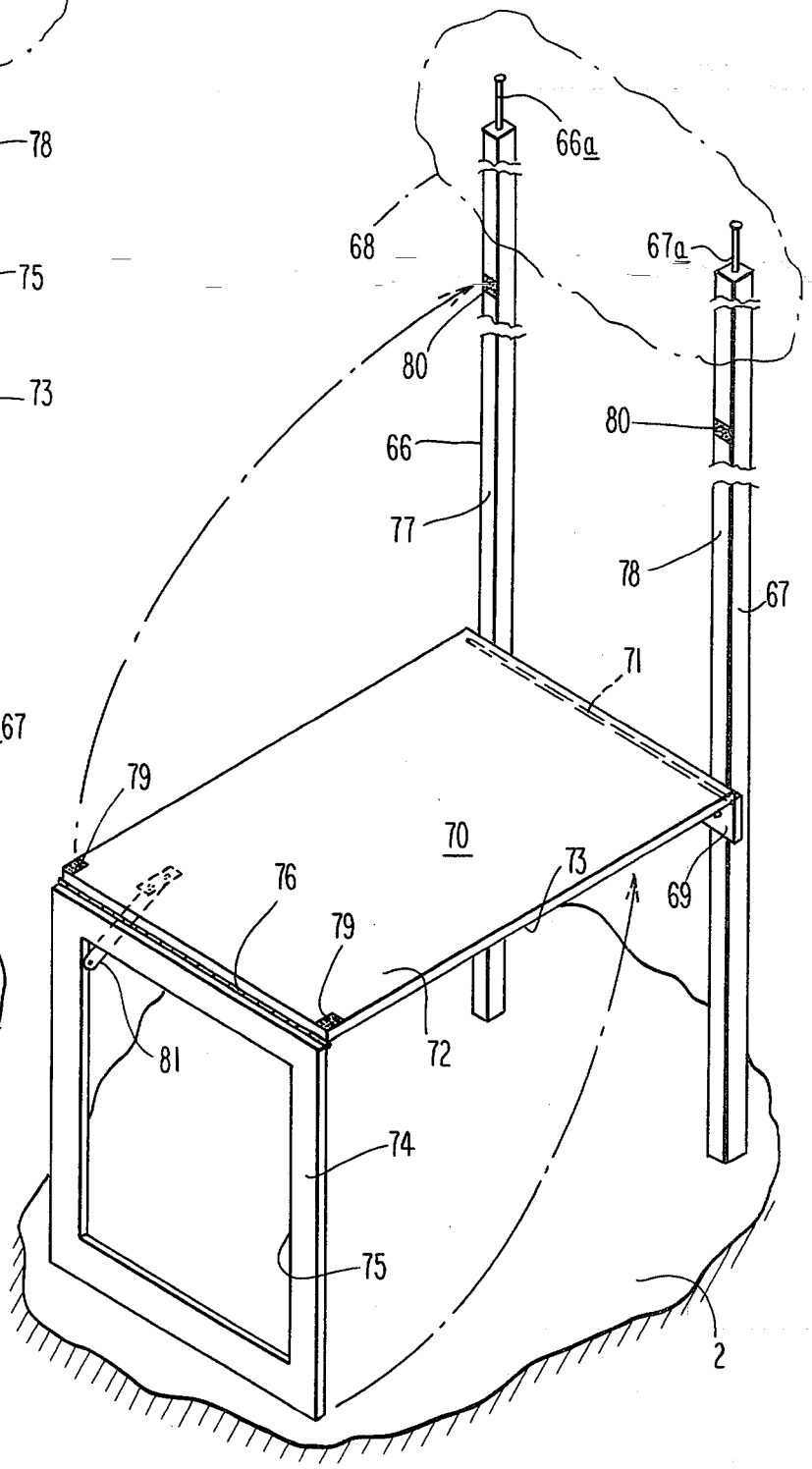

MULTI-PURPOSE FURNITURE

This invention relates to furniture and especially highly functional and aesthetic furniture for homes and offices and the like.

More particularly, the invention relates to furniture desirably employed in environments where space for work and storage areas is at a premium and where the environment nevertheless demands an artful, pleasing and uncongested appearance.

To the above end, the furniture of invention contemplates certain basic functional/structural components which are placed together to achieve storage, display and utility conditions, the conditions minimizing floor space but providing adequate work and storage facilities and achieving a highly pleasing decor.

The furniture of the invention will be described below in connection with the following drawings wherein.

Figure 1:
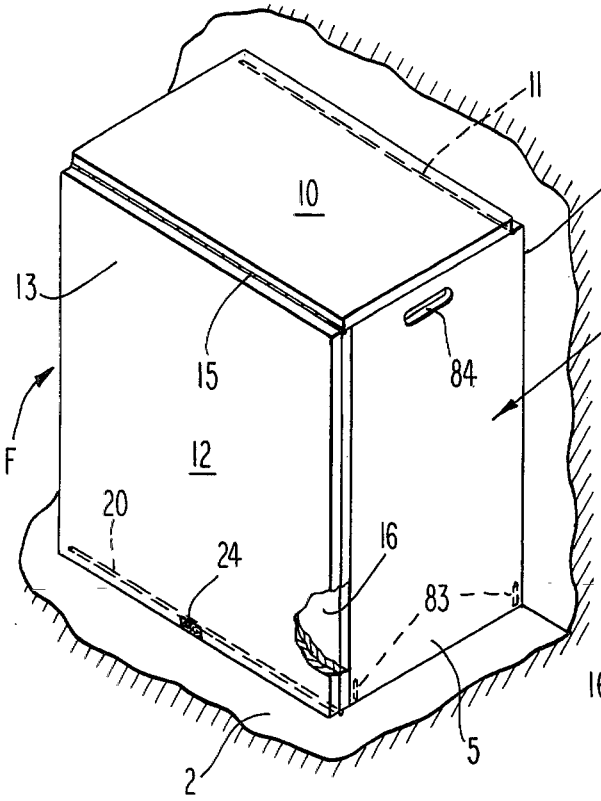
FIG. 1 is a perspective view illustrating furniture of the invention in a storage condition.
Figure 2:
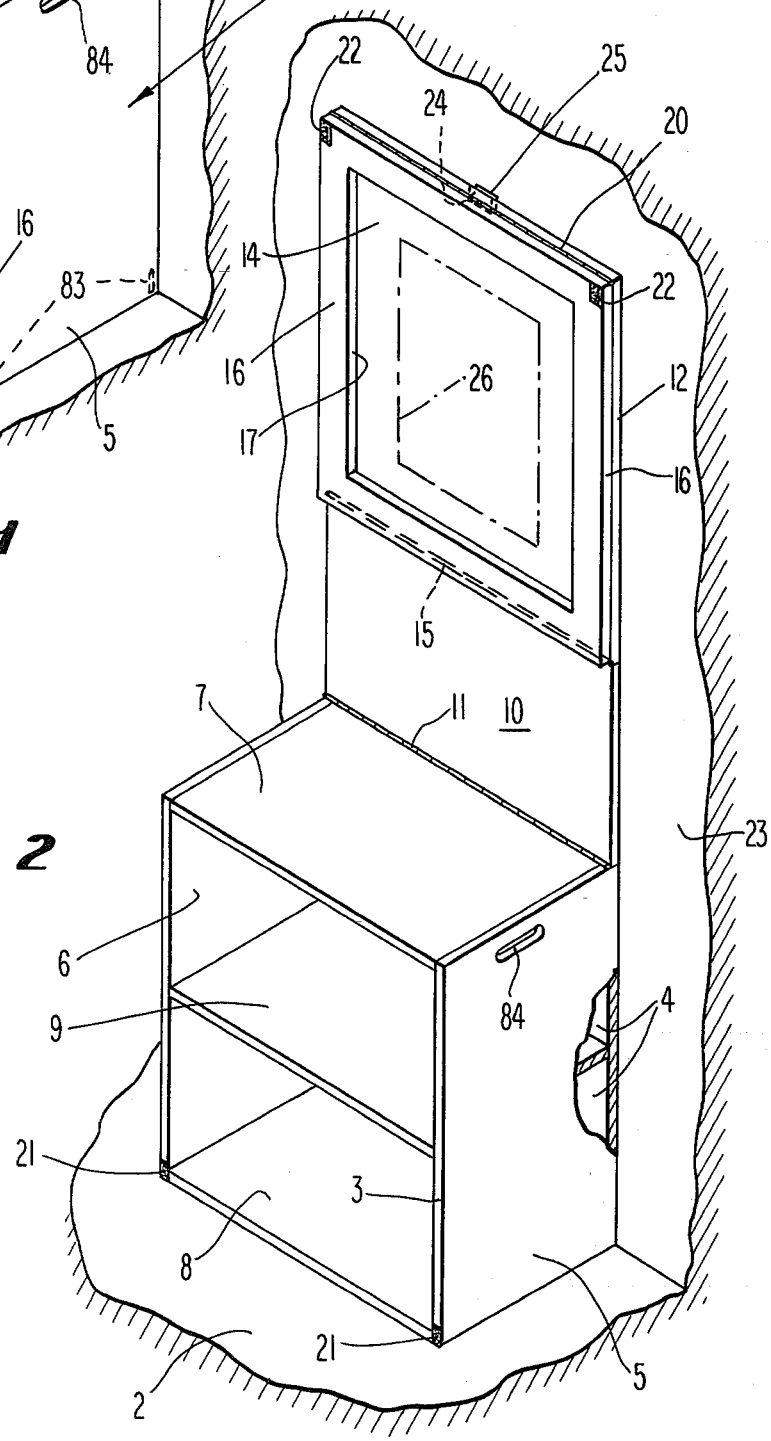
FIG. 2 is a perspective view of the furniture of FIG. 1 illustrating a display condition.
Figure 3:
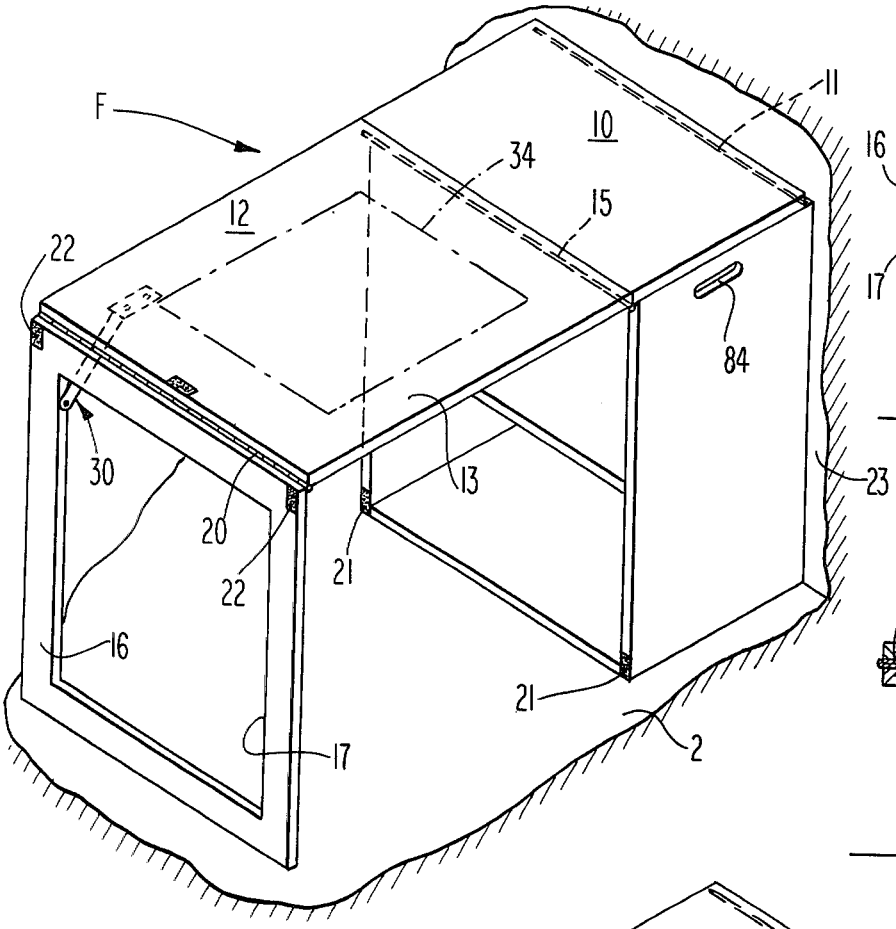
FIG. 3 is perspective view illustrating the furniture of FIG. 1 in a utility condition.
Figure 4:
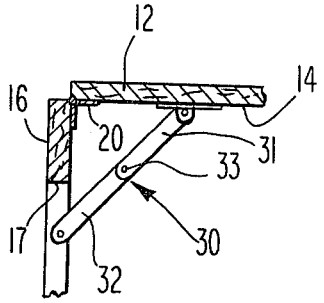
Figure 4:
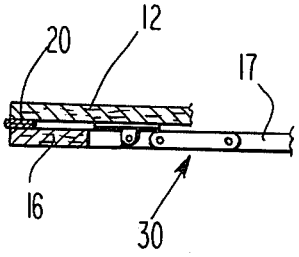
Figure 4:
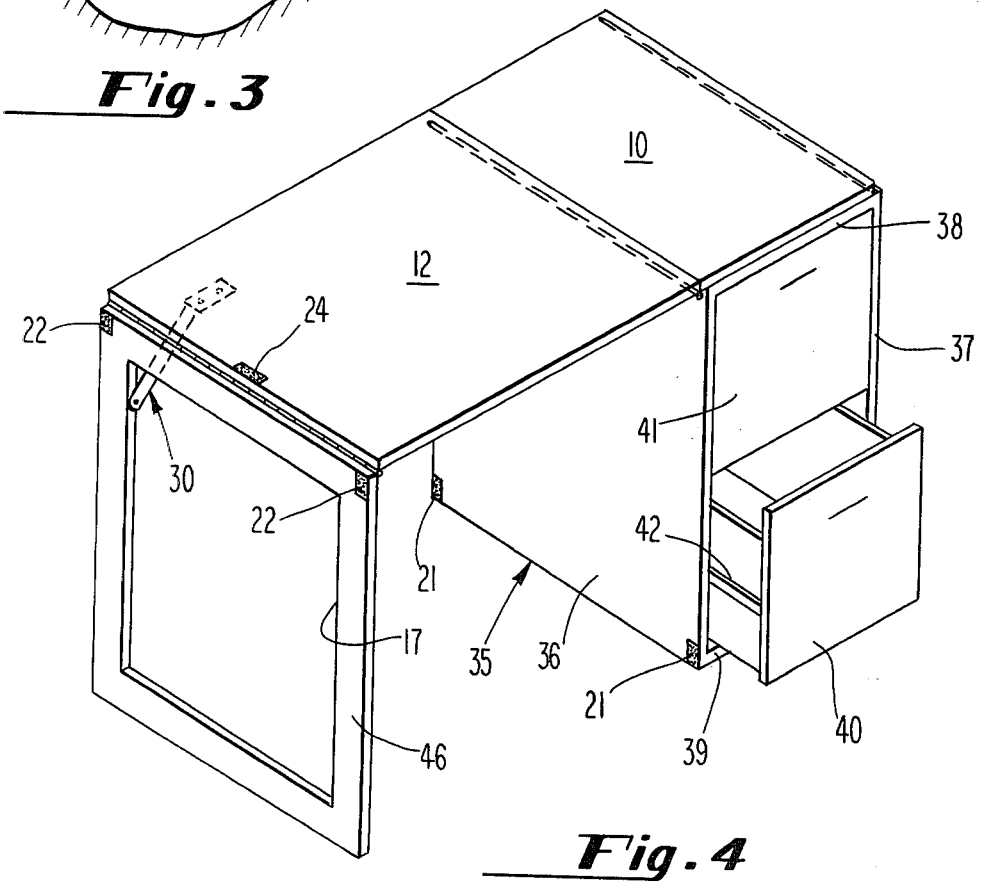

FIGS. 3-A and 3-B are fragmentary views respectively of open and closed positions of a folding brace employed with the furniture of FIGS. 1–3;

FIG. 4 is a perspective view of a modified version of the furniture of FIG. 1 illustrating a utility condition;

FIG. 5 is a perspective view illustrating furniture of the invention in a display condition;

FIG. 6 is a perspective view of furniture of FIG. 5 in a utility condition;

FIG. 7 is a perspective view of furniture of the invention in a display condition; and FIG. 8 is a perspective view of the furniture of FIG. 7 in a utility condition.

Referring to FIGS. 1 and 2 the furniture unit F has a support or storage means 1 which stands upright on a floor 2 of a building structure. The storage means includes front section 3 and rear section 4, side sections 5 and 6, a top section 7 and bottom section 8. Interior of the storage means 1 is mechanism for the storage of articles which in this case comprises the shelf 9 and the bottom 8 which also serves as a shelf.

It will be observed that each of the above mentioned sections is flat and rectangular in shape. The components mentioned are preferably fabricated from flake board the surfaces of which have a plastic laminate. The laminates may be any of a variety of colors.

A first or intermediate panel 10 is flat, rectangular in shape and is substantially the same area as the top section 7. The panel 10 is mounted on the storage means 1 as by hinge means 11 located at the intersection of the rear and top sections 4 and 7. The hinge means 11 is preferably a piano hinge, one leaf of which is connected to the top section 7 and the other to the adjacent edge of the intermediate panel 10.

The hinge means 11 permits the intermediate panel 10 to pivot as between the vertical position shown in FIG. 2 to the horizontal position shown in FIG. 1. In the vertical position the panel extends vertically upwardly from the top 7 and is generally coplanar with the rear 4. In the horizontal position of FIG. 1, the panel 10 engages the top section 7.

A second or work panel 12 (FIG. 2) is flat, rectangular in shape and has substantially the same area as the area of the front section 3. The work panel 12 has a top surface 13 (FIG. 2) and bottom surface 14 (FIG. 1).

Hinge means 15 pivotally connects the work panel 12 with the intermediate panel 10. As noted, the hinge means 15 is located on the edge of the intermediate panel 10 opposite to the edge bearing the hinge means 11. Like the hinge means 11, the hinge means 15 is a piano hinge with one leaf attached to the edge of intermediate panel 10 and the other leaf attached to the edge of the work panel 12.

The hinge means 15 permits the work panel 12 to pivot with respect to the intermediate 10 so as to be oriented for the storage condition of FIG. 1, the display condition of FIG. 2 and the utility conditions of FIGS. 3 and 4 as will presently be noted below:

A utility member 16 is flat, rectangular in shape and has substantially the same area as the area of the front section 3 and of the work panel 12. The utility member 16 also has an opening 17.

Hinge means 20 pivotally connects the work panel 12 and the utility member 16. The hinge means is located in the edge of the work panel 12 which is opposite to the edge having hinge means 14. Like the hinge means, 11 and 14 the hinge means 20 is a piano hinge with one leaf on the surface of panel 12 and the other leaf on the surface, the utility member 16. The hinge means 20 permits the utility member to be oriented for the storage, display and utility positions as will be noted below.

The location, orientation and function of the intermediate panel 10, the work panel 12 and the utility member 16 in the storage, display and utility conditions of FIGS. 1–4 will now be described:

In the storage condition of FIG. 1 the hinge means 11, 15, and 20 have provided for the intermediate panel 10, work panel 12 and the utility member 16 to be pivoted with respect to the storage unit 1 so that: the intermediate panel 10 is down on and engagement with the top 7; the utility member 16 has been folded back on the work panel 12 in engagement with the bottom surface 14 and also in engagement with the front section 3. The work panel 12 and utility member 16 extend vertically and parallel to the front section 3. The top surface 13 of the work panel 12 faces outwardly.

Means are provided to releasably retain the work panel 12 and utility member 16 fast against the storage unit 1. A typical retaining means may comprise VELCRO fasteners as indicated in FIG. 2. The bottom of the front 3 has a pair of VELCRO fastening sections 21 and the utility member 16 has a corresponding pair of VELCRO fastening sections 22.

It will be apparent that when the work panel 12 and utility member are rotated into the storage condition of FIG. 1 the corresponding VELCRO sections 21 and 22 will engage and inconjunction with hinge means 15 holds the work panel 12 and utility member 16 in position.

With reference to FIG. 1, it will be noted that the shelf means has been closed off and that the intermediate panel 10 can be used as a table or a shelf. Moreover, where neither the shelf means of the panel 10 is used for storing items, the unit may be turned over with the side 4 on the floor and the surface 13 of work panel 12 used as a utility table or a cocktail table.

Turning now to the display condition of FIG. 2 the hinge means, 11, 15 and 20 have provided for the panels and utility member to be oriented as follows: the intermediate panel 10 extends vertically upward from the top 10; the work panel 12 extends vertically upwardly from the intermediate panel 10 generally planar therewith; and the utility member remains in the same position with respect to the work panel 12 as in FIG. 1.

The display condition contemplates that the furniture unit F abut a vertical wall such as 23 or some like medium. Means are provided in the display condition to releasably retain the panels 10 and 12 in the vertical orientation. Typical means for such retention may comprise VELCRO fasteners. Referring to FIG. 1 the top surface 13 of the panel 12 has a VELCRO fastening section 24 and the wall 23 has a corresponding fastening section 25. Thus, when the panel 12 is rotated against the wall the fastening units 24 and 25 engage and in conjunction with the hinge means the panels 10 and 12 and utility member in place.

It will be observed that in the display condition, the shelf 9 and top 7 are both uncovered and available for articles to be received or retrieved.

The display condition provides means for enhancing the decor of the environment with which the furniture unit is employed. For such purposes, the opening 17 of utility member 16 provides a frame for intelligence 26 formed on the bottom surface 14 of panel 12. The intelligence 25 may be decorative, functional or informational such as a picture, a poster, a mirror, a message center, a chart and the like. The intelligence 26 is selected to fit the environment with which the furniture unit is employed.

Turning now to the utility position of FIG. 3, it will be observed that the hinge means 11, 15 and 20 have provided for the panels and utility member to be rotated as follows: the intermediate panel 10 is down in a horizontal position against the top 7; the panel 12 remains co-planar with the panel 10 and extends horizontally outwardly; the utility member 16 extends vertically downwardly at right angles from the panel 12 with the lower edge engaging the floor 2. The hinge 15 and the utility member 16 maintain the work panel 12 horizontally at conventional desk or table height.

For purpose of releasably maintaining the panel 12 and utility member in the angled orientation of FIG. 3, I have provided a releasably locking means in the form of a folding brace 30. The open and closed positions of the brace are illustrated in FIGS. 3-A and 3-B. As noted, the arms 31 and 32 are joined by pivot 33 with the arm 31 being connected to the bottom surface 14 of panel 12 and the arm 32 being connected to the utility member 16 within the opening 17. In the folded condition of FIG. 3-B the arms 31 and 32 are side-by-side within the opening 17 and thus offer no interference to the utility member 16 folding back on the work panel 12.

As will be apparent, the utility position of FIG. 3 presents work panel 12 and intermediate panel 10 in an orientation giving rise the myriad of uses to which a desk top or table top may be employed. Aside from such conventional utility, the invention contemplates further utility in that the top surface 13 of the panel 12 is provided with intelligence noted by the dotted lines 34. The intelligence 34 may be coordinated with the content of the intelligence 26 or may be entirely independent and purely functional such as a game board.

The storage mechanism in storage or support means 1 can take a form other than shelf means and an example of this is shown in FIG. 4.

The storage unit 35 has front section 36, rear section 37, top section 38 and bottom section 39. These components are substantially the same size and structure as the corresponding components in FIGS. 1 thru 3 except that the front section 36 is closed.

The unit 35 mounts intermediate and work panels, a utility member, Velcro units and a folding brace which are the same as the components in FIGS. 1–3 and therefore have the same numbers in FIG. 4.

The storage mechanism of FIG. 4 comprises a pair of file drawers 40 and 41 mounted between the front 36 and rear 37. The drawers are suspended on the front and rear by conventional extensible slides one of which is indicated at 42.

In considering the structure described above it will be evident that the storage or support means 1 and 2 make available both a storage function and a support function for the panels 10 and 12 and utility member 16. The storage function may not be employed depending on the use being made of the unit. Also, it will be observed that the storage or support means 1 and 35 rest directly on the floor 2. The invention contemplates, however, that the storage or support means be supported above and spaced from the floor.

The arrangement is advantageous where additional shelving or file drawer space is periodically needed since such units can be placed in the free space below the elevated unit according to requirements. Moreover, the free space is advantageous where unobstructed floor space is needed.

An example of the elevated arrangement is shown in FIGS. 5 and 6. A storage or support unit 43 has a front section 44, a rear section 45 side sections 46 and 47, bottom and top sections 50 and 51. Each of the sections is flat and rectangular in shape.

The storage or support means 43 is maintained above the floor 2 by a storage or support means 52 which is similiar in construction to the storage or support means 1 of FIGS. 1–3 and has wider side sections to provide for the shoulder 53. It will be apparent that the storage or support means 52 may take the form shown in FIG. 4.

A work panel 54 (corresponding to panel 12) on the unit 43 by hinge means 55 located at the intersection of the front section 44 and the bottom section 50. The hinge means is a piano hinge one leaf of which is connected to the front edge of the bottom section 50 and the other leaf to the adjacent edge of the panel 54. The hinge means 55 permits the panel to pivot as between the vertical position of FIG. 5 and the horizontal position of FIG. 6.

The panel 54 is flat, rectangular and has substantially the same area as the front section 44. The top surface of the panel is noted at 56 and the bottom surface at 57.

The utility member 60 (corresponding to member 16) is flat, rectangular in shape. The member has an opening 61 and is connected to the work plate 54 by the hinge means 62. The hinge means 62 is a piano hinge one leaf of which is connected to work panel 54 and the other leaf to the utility member 60.

The hinge means 55 and 56 permit the panel 54 and the utility member 60 to pivot as between the display condition of FIG. 5 and the utility condition of FIG. 6.

In the display condition, the top surface 56 of work panel 54 engages the front section 44 and is held in position by the VELCRO fastening sections 63 and 64. The utility member 60 is folded back on the bottom surface 57 of panel 54 and the opening 61 frames the intelligence 65 on the surface 57. The intelligence 65 may be of the same nature as the intelligence 26 or 34.

In the utility condition of FIG. 6 the work panel 54 and the utility member 61 are pivoted so that the work panel 54 extends horizontally outward from the storage or support means 43 and the utility member extends vertically downward at right angles to work panel 54 with the lower edge engaging the floor. The panel and utility member are releasably maintained in the utility condition by the folding brace 30 which has the same construction as brace 30. The panel 54 is at table or desk height.

In cases where floor space is required, the unit 52 may be eliminated and the storage or support means 43 mounted on a vertical wall or like structure.

The invention contemplates that the support means for work panel and utility member take the form of ceiling-to-floor poles, wall-mounted channels or other wall-type supports. A typical arrangement using poles is shown in FIGS. 7 and 8.

In FIG. 7 a pair of poles 66 and 67 extend between the floor 2 and ceiling 68. The poles have spring loaded plungers 66*a* and 67*a* which engage the ceiling and maintain the poles in position. The poles are joined by a connecting bar 69.

A work panel 70 is connected to the bar 69 as by the hinge means 71. The top of the work panel is indicated at 72 and the bottom by 73. A utility member 74 is connected to the work panel 70 as by hinge means 76. The hinge means 71 is a piano hinge with one leaf connected to the top edge of bar 67 and the other leaf to bottom surface 73.

The work panel 70 is flat, rectangular similarly as the work panels mentioned heretofore.

A utility member 74 is flat and rectangular in shape and has an opening 75. The utility member is connected to the work panel 70 by the hinge means 76 which is a piano hinge.

The hinges 71 and 76 provide for the work panel 70 and utility member to pivot as between the display condition of FIG. 7 and the utility position of FIG. 8.

In the display condition the top surface 72 engages the front surfaces 77 and 78 of poles 64 and 65 and is held by the VELCRO sections 79 and 80. The front surfaces 77 and 78 of the poles are analogous to the front surfaces 3, 36 and 44 mentioned heretofore. The bottom 73 is provided with intelligence 82 of the kind heretofore described. The opening 75 frames the intelligence 82.

In the utility position of FIG. 8 the work panel 70 extends horizontally outwardly from the poles and the utility member extends down at a right angle to engage floor 2 and is held by holding brace 81. The panel 70 is at desk or table height.

Before closing it is pointed out that the storage or support unit 1 of FIG. 1 may be provided with ball caster sockets at each corner (two of which are indicated at 83) to accept ball casters and provide for complete mobility. One or more hand-holds 84 are used for movement purposes.

I claim:

1. A multi-purpose furniture item for use in a building structure having a floor comprising:

support means to stand upright on said floor and having vertically extending front and rear sections and a horizontally extending top section extending between the front and rear sections, the support means including interior mechanism to support articles to be stored, each said section being flat and rectangular in shape;

an intermediate panel, the intermediate panel being flat, rectangular in shape and having substantially the same area as the area of said top section;

first hinge means connecting the intermediate panel to the support means at the intersection of the top and rear sections;

a work panel, the work panel being flat, rectangular in shape and having substantially the same area as the area of said front section and having top and bottom surfaces;

second hinge means connecting the work panel with the intermediate panel along the edge of the intermediate panel opposite to said one edge of the intermediate panel;

a utility member, the member being flat, rectangular in shape and having substantially the same area as the area of said front section;

third hinge means interconnecting said utility member with said work panel along the edge of the work panel opposite to the edge having said second hinge means;

said first, second and third hinge means providing for the panels and utility member to be oriented for a storage condition, a display condition and a utility condition;

(a) in the storage condition, the intermediate panel engaging said top section, the utility member being folded back on and engaging the bottom surface of said work panel and also engaging said front section;

(b) in the display condition, the intermediate panel extending vertical upwardly from said top section, the work panel extending vertically upwardly from the first panel and co-planar therewith and the utility member being folded back on and engaging the bottom surface of said work panel;

(c) in the utility condition, the intermediate panel engaging said top section, the work panel extending horizontally outwardly generally co-planar with the intermediate panel and the utility member extending vertically downwardly from the work panel in engagement with said floor and cooperating with said second hinge means to support the work panel in said horizontal position;

means operative in said utility condition to releasably maintain said work panel and said utility member in said angular orientation;

means operative in said display condition to maintain the intermediate and the work panels in said vertical orientation.

2. The combination of claim 1 wherein said front section has an opening and said mechanism comprises shelf means accessible thru said opening.

3. The combination of claim 1 wherein said mechanism comprises at least one file drawer mounted between said front and rear sections for sliding motion as between a closed position and an open position.

4. The combination of claim 1 wherein said bottom surface of said work panel has means forming intelligence and said utility member has an opening, the opening providing visual access to and frame means for said intelligence in said display condition.

5. The combination of claim 1 wherein said top surface of said work panel has means forming intelligence accessible in said utility position.

6. A multi-purpose furniture item for use in a building structure comprising:

a pair of elongated, vertically oriented, spaced apart poles, the bottom of each pole being adapted to be mounted on the floor of a room and each pole including a spring-loaded plunger at the top thereof to engage the ceiling of a room when the bottom is mounted on the floor whereby to vertically support the pole in the room;

horizontally extending bar means connecting the poles;

a work panel, the work panel being flat, rectangular is shape and having a top surface and a bottom surface;

means on the bottom surface forming intelligence;

first hinge means connecting said work panel to said bar means and adapting the work panel to rotate about a horizontal axis relative to the bar means;

a utility member, the member being flat and rectangular in shape and having an opening;

second hinge means connecting the utility member with said work panel and adapting the utility member and work panel to relatively rotate about a horizontal axis oriented generally parallel first said horizontal axis;

said first and second hinge means providing for the work panel and the utility member to be oriented in a display condition and in a utility condition;

(a) in said utility condition the top surface of said work panel engaging said poles and said utility member being folded back on and engaging the bottom surface of said work panel whereby the opening in the utility member provides visual access to and frame means for said intelligence;

(b) in said utility condition, the work panel extending horizontally outwardly from the poles and the utility member extending vertically downwardly from the work panel in engagement with said floor and cooperates with said first hinge means to support the work panel in said horizontal position;

means operative in said utility condition to releasably maintain the work panel and said utility member in said angular orientation; and means operative in said display condition to releasably maintain the work panel against said poles.

* * * * *